United States Patent [19]

Christy

[11] Patent Number: 4,909,441

[45] **Date of Patent: * Mar. 20, 1990**

[54] ELASTOMERIC FLOW CONTROL VALVE

[76] Inventor: Mark H. Christy, 1501 E. Ocean Blvd., Balboa, Calif. 92661

[ * ] Notice: The portion of the term of this patent subsequent to Sep. 26, 2006 has been disclaimed.

[21] Appl. No.: 362,073

[22] Filed: Jun. 6, 1989

Related U.S. Application Data

[63] Continuation-in-part of Ser. No. 198,336, May 25, 1988, Pat. No. 4,869,432, which is a continuation-in-part of Ser. No. 128,880, Dec. 4, 1987, Pat. No. 4,846,406.

[51] Int. Cl.[4] ..... B05B 15/02; B05B 1/32

[52] U.S. Cl. ..... 239/109; 239/533.13; 239/542; 138/45

[58] Field of Search ..... 239/542, 547, 510, 533.13, 239/106–109; 138/572, 45

[56] References Cited

U.S. PATENT DOCUMENTS

| | | | |
|---|---|---|---|
| 2,632,476 | 3/1953 | Miller | 138/45 |
| 3,837,363 | 9/1974 | Meronek | 239/533.13 |
| 3,899,136 | 8/1975 | Harmony | 239/542 |
| 4,095,745 | 6/1978 | Christy et al. | 239/109 |
| 4,113,180 | 9/1978 | Christy et al. | 239/109 |

*Primary Examiner*—Andres Kashnikow
*Assistant Examiner*—Kevin P. Weldon
*Attorney, Agent, or Firm*—Phillips, Moore, Lempio & Finley

[57] ABSTRACT

A pressure modulated flow control valve, particularly adapted for water irrigation applications, comprises an unitary elastomeric pin defining a flow passage therethrough, a sub-chamber formed entirely in the pin and communicating with an inlet to the valve, and a flexible diaphragm separating the sub-chamber from the flow passage. In operation, the diaphragm is exposed to water pressure prevalent in the sub-chamber to flex into and vary the size of the flow passage to control and modulate the flow rate therethrough. The interchangeable pin is mounted in a housing of the control valve to effect a preselected near constant flow rate through the flow passage.

19 Claims, 4 Drawing Sheets

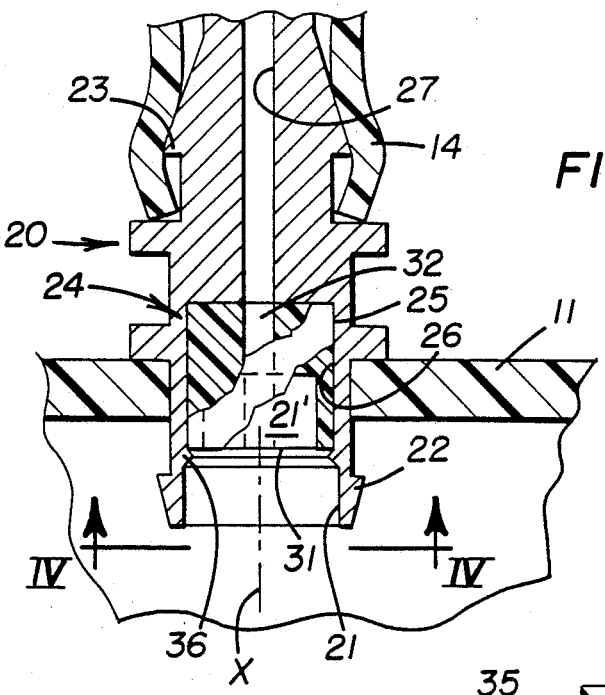
FIGURE 3
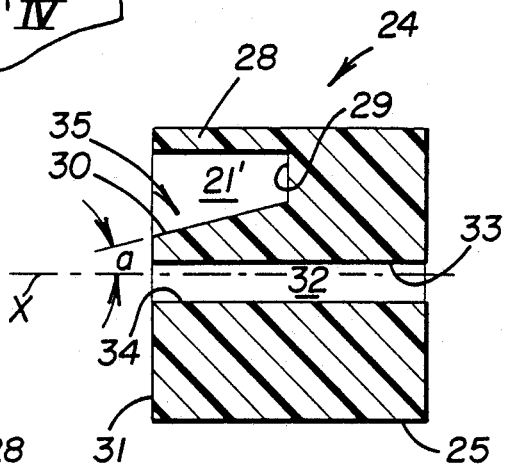
FIGURE 5
FIGURE 4
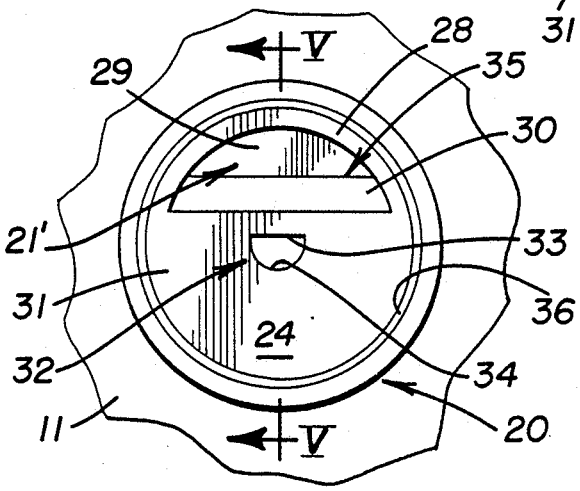

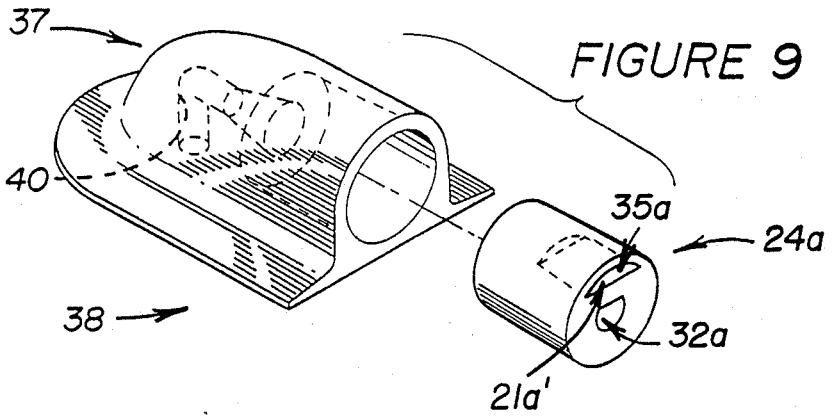
FIGURE 9
FIGURE 8
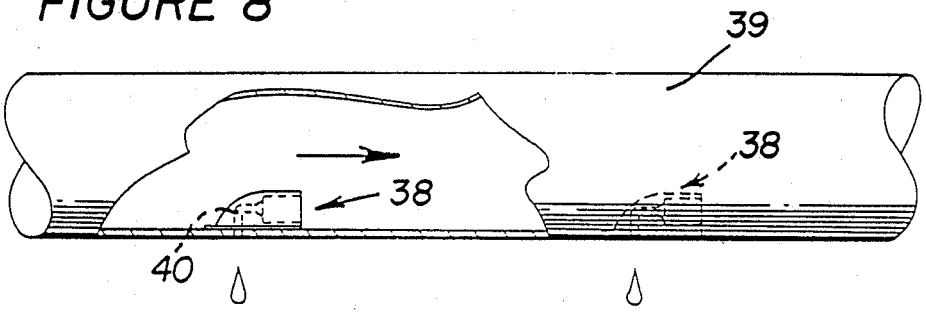
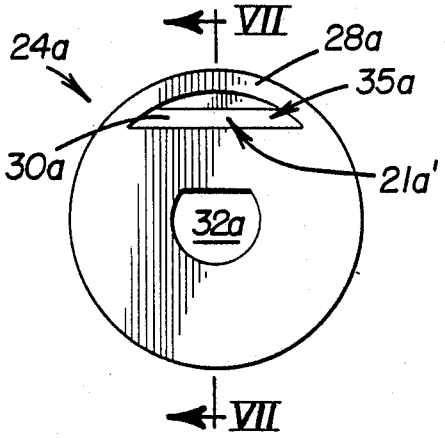
FIGURE 6
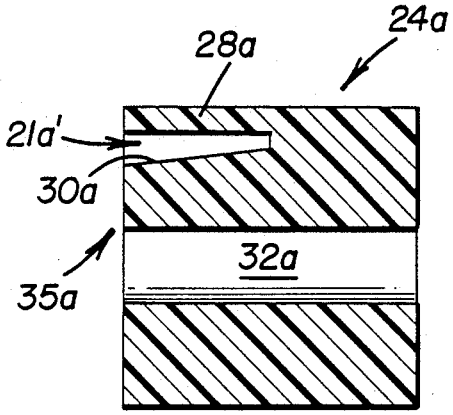
FIGURE 7

ELASTOMERIC FLOW CONTROL VALVE

CROSS-REFERENCE TO RELATED APPLICATION

This application is a continuation-in-part of U.S. Patent Application Ser. No. 198,336, filed on May 25, 1988 for "Elastomeric Flow Control Pin for Irrigation Systems," now U.S. Pat. No. 4,869,432 which is, in turn, a continuation-in-part of U.S. Patent Application Ser. No. 128,880, filed on Dec. 4, 1987 for "Micro Flow Control Valve For Irrigation Systems And Method" and now U.S. Pat. No. 4,846,406, issued on July 11, 1989.

TECHNICAL FIELD

This invention relates to a pressure modulated flow control valve and, more particularly, to a flow control valve having an interchangeable pin for controlling the flow rat therethrough.

BACKGROUND OF THE INVENTION

The popularity of "micro" flow irrigation systems (e.g., rated from approximately 1.0 gph to 60.0 gph) for garden and related agricultural uses, has dictated the need for pressure modulating flow control valves that will communicate a near constant flow rate to a water distributing device, such as a sprayer or drip type emitter. Systems of this type include a main water line in the form of a plastic tube and a series of suitably spaced smaller plastic tubes or branch lines interconnected between the main water line and each water distributing device. In addition to the problem of not providing a substantially constant flow rate of water to the distributing device, many conventional systems are prone to clogging.

Various pressure-compensating flow control valves have been proposed for solving the above, briefly described problems in the field of irrigation. For example, applicant's U.S. Pat. No. Re 29,022 discloses various embodiments of a self-flushing and pressure compensating irrigation valve that will function to maintain a predetermined near constant flow rate of water at the outlet thereof in response to fluctuations of main line water pressure. Although valves of this type work quite well for many irrigation applications, there is a need for a less complex valve hat can be manufactured economically and installed or replaced more expeditiously.

Further, pressure modulating valves of the latter type are oftentimes designed to have flexible lips, composed of a highly flexible elastomeric material, that are entirely surrounded by water at the inlet to the valve. Flexing and deformation of the lips during operation render it difficult, at times, to closely calibrate and closely control the desired near constant flow rate of the valve.

SUMMARY OF THE INVENTION

An object of this invention is to provide an improved pressure modulated flow control valve that is 4. economical to manufacture, exhibits a high degree of structural integrity and is highly efficient in operation. (See FIGS. 10 and 11 for near constant uniformity coefficients).

The flow control valve of this invention is particularly adapted for use in irrigation systems wherein it is desired to provide a near constant flow rate of water, e.g., within the approximate overall maximum range of from 1.0 gph to 60.0 gph. In pressure modulated systems of this type, water is communicated to a water distributing device, such as a mini-sprayer or drip-type emitter. The flow control valve will find other applications in pressure modulated fluid control systems, well-known to those skilled in the arts relating hereto.

The flow control valve comprises an unitary elastomeric pin defining at least one flow passage therethrough, a sub-chamber formed entirely within the pin and communicating with an inlet to the valve and a flexible diaphragm separating the sub-chamber from the flow passage and adapted to be subjected to fluctuating fluid pressures in the sub-chamber. The diaphragm will flex into and vary the size of the flow passage to maintain the flow rate of the fluid at a predetermined near constant flow rate in response to a pressure differential produced between the flow passage and the sub-chamber. The pin is adapted to be snugly mounted within a housing and can be replaced with a pin rated at different flow rate.

A plurality of the control valves are adapted to be connected within an irrigation system for communicating a near constant flow rate of water to a plurality of water distributing device, such as a mini-sprayers or drip-type emitters.

BRIEF DESCRIPTION OF THE DRAWINGS

Other objects and advantages of this invention will become apparent from the following description and accompanying drawings wherein:

Figure partially 1 illustrates an irrigation system, including a flow control valve embodiment of this invention adapted to communicate water to a water distributing device at a near constant flow rate;

FIG. 3 is a longitudinal sectional view of the assembled control valve, generally taken in the direction of arrows III—III in FIG. 1;

FIG. 4 is an end elevational view of the control valve, taken in the direction of IV—IV in FIG. 3;

FIG. 5 is a longitudinal sectional view of a pin employed in the control valve, taken in the direction of arrows V—V in FIG. 4;

FIG. 6 is an end elevational view, similar to FIG. 4, illustrating a modification of the pin only;

FIG. 7 is longitudinal sectional view of the latter pin, taken in the direction of arrows VII—VII in FIG. 6;

FIG. 8 i a partially sectioned side elevational view, illustrating a plastic drip irrigation tube having a pair of flow control valves or emitters of this invention mounted therein; and FIG. 9 is an exploded isometric view of one of the control valves of FIG. 8, showing its pin removed from a housing thereof.

DESCRIPTION OF THE PREFERRED EMBODIMENTS

GENERAL DESCRIPTION

Figure 1:
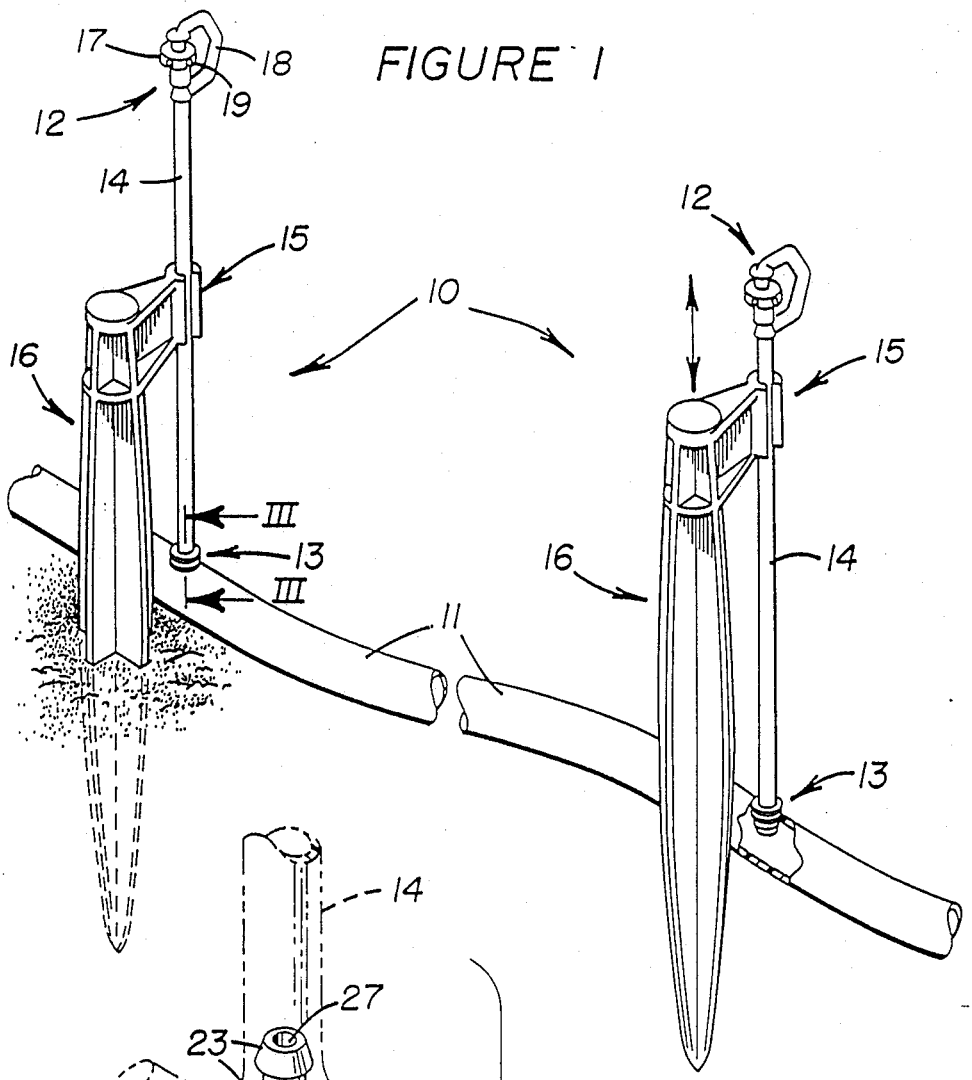
Figure 2:
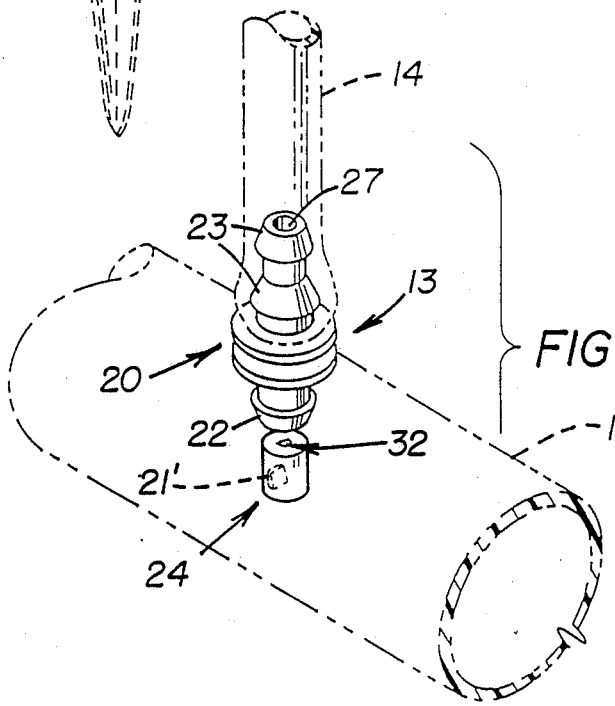
FIG. 2 is an exploded isometric view of the control valve, prior to its assembly in the irrigation system.

FIG. 1 partially illustrates an integrated irrigation system 10 comprising a main water line in the form of a plastic tube 11 for supplying water at a variable pressure level, within the approximate range of from 10 psi to 60 psi, to a plurality of water distributing devices, shown in the form of mini sprayers 12. In certain irrigation systems, the water is admixed with sulfuric acid, chlorine, fertilizers or the like in a conventional manner. A pressure modulated flow control valve 13, embodying this invention, is interconnected between the main water line and a respective branch line or plastic tube 14 having sprayer 12 suitably connected to an upper end thereof. The tube is adjustably mounted in semi-tight, slip-fit relationship within a bracket 15, extending transversely from an upper end of a support stake 16, whereby the sprayer can be adjusted vertically relative to the stake and ground level.

As described more fully hereinafter, water communicated to sprayer 12 from control valve 13 is maintained at a predetermined near constant flow rate, preferably selected from within the approximate overall maximum range of from 1.0 gph to 60.0 gph and more commonly from within the range of from 2.0 gph to 30.0 gph for irrigation purposes. This near constant flow rate will be maintained despite fluctuations in water pressure communicated to an inlet of the control valve from main water line 11, i.e., pressure modulation. In other commercial applications of this invention, such range could be expanded to 0.25 gph to 240 gph and fluids other than water can be utilized. As further described hereinafter, the control valve is self-purging to prevent foreign particle build-up therein which might affect its operation.

Conventional mini-sprayer 12 comprises an annular head 17 rotatably mounted within a C-shaped support arm 18 with the head having at least one pair of diametrically opposed and vertically disposed slots 19 defined externally thereon. The slots are inclined slightly relative to the longitudinal axis of head 17 whereby pressurized water emitted from the outlet end of the tube will impinge within the slots and rotate the head to distribute the water in a spray-like fashion.

It should be understood that other types of water distributing devices can be used with the pressure modulated flow control valve of this invention. For example, and briefly referring to FIGS. 8 and 9, the flow control valve is adapted for use with drippers or emitters, either connected directly to a branch tube of an irrigation system or mounted within a larger water line thereof, such as that shown in these figures. Further, the flow control valve is adapted for use in other fluid circuits for closely controlling fluid outlet flow in a pressure modulated manner (e.g., vacuum breakers, air relief valves, water purification systems, etc.), as will be appreciated by those skilled in the arts relating hereto.

DETAILED DESCRIPTION

Referring to FIGS. 2–5, flow control valve 13 comprises a tubular housing 20 defining a water receiving cylindrical chamber 21 at the inlet to the valve. The chamber is adapted to receive water or other fluid from main line 11 at a fluctuating working pressure level, normally within the approximate range of from 10 psi to 60 psi for most water irrigation applications for which this invention is particularly adapted. One or more annular barbs 22 are formed externally at the inlet end of the housing for the purpose of piercing main water line 11 in a conventional manner to anchor and seal housing 20 of the control valve thereat. A similar barb or barbs 23 are formed at the outlet end of the housing for attaching and sealing the inlet end of tube 14 thereat in a conventional manner.

Flow control valve 13 further comprises a body element, shown in the form of a generally cylindrical and unitary elastomeric pin 24. A cylindrical outer surface 25 of the pin is adapted to be slip-fit and snugly held within a bore 26 of housing 20 which defines inlet chamber 21 at the inlet end of the housing and valve. Bore 26 communicates with a cylindrical passage 27, formed through the housing to communicate with tube 14 and which is disposed on a longitudinal axis X of the housing and integrated control valve (FIG. 3).

Pin 24 is entirely composed of an elastomeric material exhibiting sufficient flexibility and related properties (e.g., durometer hardness in the approximate range of from 30 to 60) to provide the functional desiderata herein described. For example, the pin may be composed of a non-degradable natural rubber, synthetic rubber, silicone rubber or the like. Housing 20 is preferably composed of a standard semi-rigid plastic material, such as polyethylene or polypropylene.

The pin further comprises a near cylindrical or crescent-shaped outer wall 28 concentric with axis X and extending from a radial end wall 29 defining a closed, distal end of a sub-chamber 21', intermediate opposite ends of the pin. The end wall extends radially inwardly from its juncture with outer wall 28, towards axis X of the pin, and intersects a flat and exposed working surface 30. Surface 30 tapers downwardly and intersects a frontal sidewall 31 of the pin at an acute angle "a", relative to axis X. This angle is preferably selected from the approximate range of from 2° to 25° and is shown as constituting 15° in FIG. 5.

Surface 30 intersects an upper edge of frontal sidewall 31 to define a chord of a partial circle thereat, with the partial circle subscribing the inner diameter of outer wall 28 when the pin is viewed in cross-section (FIG. 4). In the embodiment illustrated, the arc subscribing the partial circle approximates 150. Outer wall 28 and surfaces 29 and 30 thus define subchamber 21', formed entirely within the pin, that continuously communicates with inlet 21. It should be understood that surface 30 could be convex, concave or assume other suitable shapes when viewed in cross-section (FIG. 4) and/or side elevation (FIG. 5).

A flow passage 32 is defined axially throughout the length o the pin to communicate with passage 27 of housing 20. As viewed in cross-section in FIG. 4, passage 32 is shaped slightly larger than a semi-circle and is defined at its upper side by a flat surface 33 perpendicular to axis X and parallel to the frontal edge of surface 30 and a partial cylindrical surface 34 underlying the flat surface. The cross-sectional area of the flow passage will vary depending on the particular valve application, e.g., such area can be selected from the range of from 0.001 to 0.005 $in^2$ for flow control valves rated from 6.5 to 2.0 gph.

The unitary elastomeric pin defines a flexible diaphragm 35, having tapered working surface 30 defined thereon, between sub-chamber 21' and flow passage 32 that is exposed to fluctuating fluid pressure prevalent at inlet 21 and in the sub-chamber. The substantial solid body portions of elastomer engaging the inner wall of housing 20 and underlying diaphragm 35 provide a firm and solid "backup" for flexing movements of the diaphragm. Thus, fluid pressure prevalent in sub-chamber 21' will only act against the exposed outer working surface 30 of the diaphragm for closely controlling the modulating water pressure to maintain a near constant flow through passage 32.

A radial flange or bead 36 may be integrally formed internally on housing 20 to extend radially inwardly adjacent to frontal side wall 31 of pin 24 (FIG. 3). When the elastomeric pin is installed in the housing, it will exhibit sufficient flexibility and related physical properties (e.g., durometer hardness) to allow it to be snapped into place behind the flange. The flange will prevent the pin from becoming dislodged from the housing, particularly when a negative vacuum is drawn in main water line 11, such as when the line is drained.

In operation, diaphragm 35 will flex into and cooperate with flow passage 32 to vary the cross-sectional area of the passage in response to pressure fluctuations in sub-chamber 21'. Such flexing will maintain the flow rate of water at the outlet of the valve at a predetermined near constant flow rate, preferably selected from within the approximate overall maximum range of from 1.0 gph to 60.0 gph for irrigation applications, despite fluctuations in water pressure in inlet chamber 21. Otherwise stated, flexing of the diaphragm is responsive to the differential in water pressure produced between inlet chamber 21 and flow passage 32.

Initial communication of water from main water line 11 to inlet chamber 21 will permit unrestricted flow through fully opened passage 32 to automatically purge the system and valve of mineral particles and other contaminants that could adversely affect the valve's operation, i.e., the valve is self-purging and self cleaning. Subsequent increases in water pressure in the inlet chamber will function to at least partially close the passage. Thereafter, water flow will proceed through the restricted flow passage with the relative opening and closing of the passage being directly responsive to the pressure differential existing between the passage and sub-chamber 21'.

Figure 10:
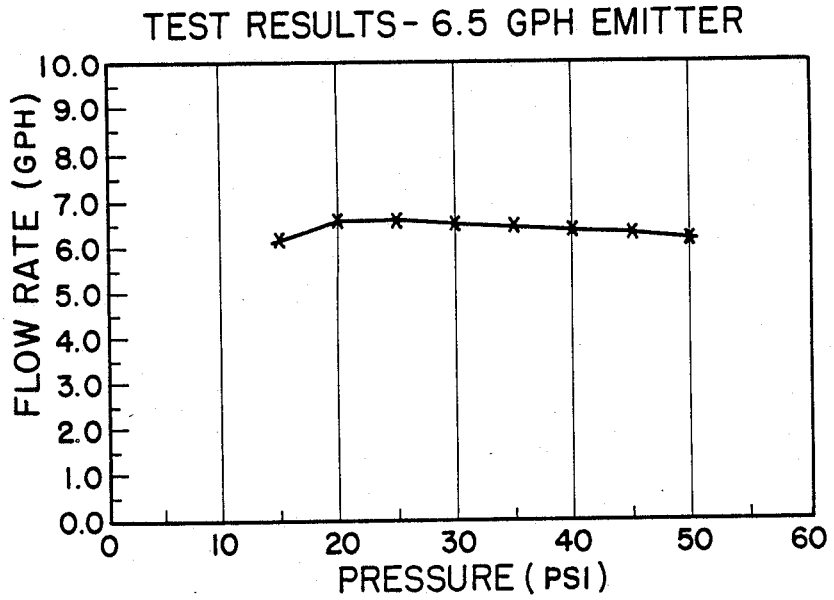

Flow control valve 13 is particularly adapted for relatively low flow rate applications in the range of from 1.0 gph to 20.0 gph, for example. The valve embodiment illustrated in FIGS. 1–5 was rated at 6.5 gph and, when tested, exhibited superior near constant flow characteristics (FIG. 10). Pin 24 was dimensioned (in inches) as follows (FIGS. 4 and 5): Outside diameter—0.250; largest (center) radial depth of shoulder 29—0.050; transverse chordal length of the frontal edge of surface 30 at sidewall 31—0.0206; transverse width of flat surface 33 of passage 32—0.130; radius of partial cylindrical surface 34 of passage 32—0.0225; radial thickness of wall 28—0.020; and minimum and maximum radial thicknesses of diaphragm 35—0.0187 and 0.05, respectively. When viewed in side elevation (FIG. 5), the length of the pin was 0.250 in., the axial length of working surface 30 of the diaphragm was 0.125 in., and angle "a" constituted 15°.

The FIGS. 6 and 7 pin embodiment **24*a* was designed to provide a controlled and rated flow rate of 20 gph. The increased flow rate, over pin 24, is primarily due to the increased thickness and mass of a modified diagram 35*a* and the increased cross-sectional area of flow passage 32*a*. Otherwise, pin 24*a* is essentially constructed the same a pin 24. It should be understood that these design parameters, as well as other dimensional and compositional design criteria, can be varied to provide a wide variety of closely controlled flow rates, e.g., within the range of from 1.0 to 60 gph and higher. The numerals appearing in FIGS. 6 and 7 (accompanied by an "a") depict like-numbered constructions and components appearing in FIG. 1–5**.

As suggested above, flow control valve 13 is particularly adapted for us in relatively low or micro flow rate irrigation applications. Flow control pins 24 and **24*a* find application as flow control valves, used in various irrigation systems of the type described above. The term "micro flow rate" as used herein means a flow rate of water or other fluid selected from within the approximate overall maximum range of from 1.0 gph to 60.0 gph, and more commonly from within the range of from 2.0 gph to 20.0 gph. The term "near constant flow rate" means a preselected and rated flow rate for a particular flow control valve that will be closely approximated when the control valve is placed in operation (e.g., pin 24 is rated at 6.5 gph whereas pin 24*a*** is rated at 20.0 gph).

FIGS. 8 and 9 illustrate the insertion of pin **24*a*, for example, into a housing 37 to provide an emitter or control valve 38, adapted for drip irrigation purposes. In particular, the housings of a plurality of the emitters can be suitably bonded or otherwise secured internally within a plastic tube or pipe 39. The emitters will function to emit water from tube 39** at a controlled drip rate, at spaced locations at ground level.

Flow passage **32*a* communicates with an outlet passage 40, formed through housing 37 of each emitter. Flexible diaphragm 35*a* will function to pressure modulate the water in the manner described above. Housing 37 is configured internally, similar to housing 20 (FIG. 3), to snugly retain pin 24*a*** therein.

Figure 11:
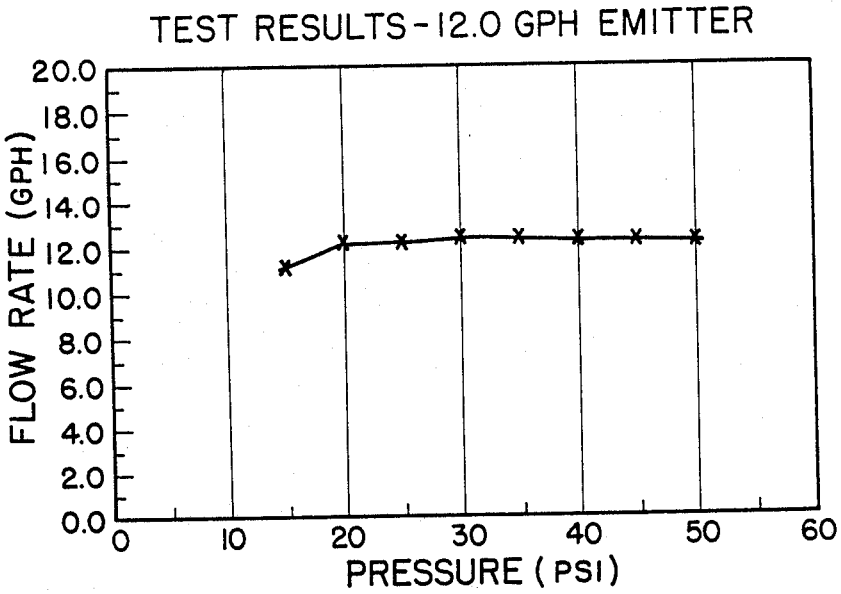
FIGS. 10 and 11 graphically depict test runs conducted on two flow control valves having different flow rates, embodying this invention.

FIG. 10 and 11 each graphically depict eight separate test runs conducted on flow control valves rated at 6.5 gph (FIGS. 1–5) and 12.0 gph, respectively. The following ranges of test data and results relate thereto:

| | 6.5 GPH | 12.0 GPH |
|---|---|---|
| NUMBER OF EMITTERS TESTED (EACH RUN) | 25 | 25 |
| MEAN FLOW RATE (GPH) | 6.13–6.55 | 11.13–12.25 |
| PRESSURE DURING TEST (PSI) | 15–50 | 15–50 |
| TEMPERATURE DURING TEST (°F.) | 68 | 68 |
| STANDARD DEVIATION (GPH) | 0.14–0.38 | 0.30–0.40 |
| COEFFICIENT OF MFG. VARIABILITY | 0.024–0.061 | 0.025–0.032 |
| DURATION OF TEST RUN (minutes) | 1.0 | 1.0 |
| EMISSION UNIFORMITY | 91.9–98.2 | 95.9–97.3 |
| UNIFORMITY COEFFICIENT | 95.4–98.2 | 97.4–98.0 |

I claim:

1. A pressure-modulated flow control valve for maintaining a predetermined near constant flow rate of fluid from a outlet thereof despite fluctuations in fluid pressure communicated to an inlet to said valve, said valve comprising a housing having a bore defined by a solid inner wall, and an unitary pin having a longitudinal axis and disposed in said bore, said pin being entirely composed of an elastomeric material and having solid body portions defining substantial outer surface portions engaging the inner wall of said housing, said pin comprising, flow passage means defined through said pin for communicating said inlet with said outlet, a sub-chamber defined entirely within said pin and solely and openly communicating with said inlet, and flexible diaphragm means separating said sub-chamber from said flow passage means adjacent to the inlet to said valve and having a working surface exposed to fluid pressure prevalent in said sub-chamber for flexing said diaphragm means into and varying the size of said flow passage means, against a firm and solid backup provided by engagement of the substantial outer surface portions of said body portion with the inner wall of said housing, to maintain the flow rate of fluid at the outlet of said valve at said predetermined near constant flow rate in response to a differential in fluid pressure produced between said sub-chamber and said flow passage means.

2. The valve of claim 1 wherein said working surface is flat and intersects a frontal edge of said diaphragm means at a frontal side of said pin.

3. The valve of claim 11 wherein said working surface tapers downwardly towards a frontal edge of said diaphragm means and converge downwardly relative to the longitudinal axis of said pin to define an acute angle therebetween.

4. The valve of claim 1 wherein said pin is cylindrical and is snugly slip-fit within the bore defined in said housing.

5. The valve of claim 4 wherein said sub-chamber terminates at its distal end at an end wall formed between opposite ends of said pin to extend inwardly from an outer boundary of said sub-chamber towards the axis of said pin and intersecting said working surface.

6. The valve of claim 5 wherein an outer wall, defining an arc of a circle, is formed on said pin to overlie said working surface and defines said sub-chamber along with said working surface and said end wall.

7. The valve of claim 6 wherein said working surface terminates at an edge at a frontal side of said pin defining a chord of a circle, said circle subscribing an inner diameter of said outer wall.

8. The valve of claim 6 wherein said end wall is positioned intermediate the ends of said pin and extends radially inwardly towards said axis from its juncture with said outer wall.

9. The valve of claim 6 wherein said working surface tapers downwardly toward a frontal side of said pin and converges relative to said axis to define an acute angle therebetween.

10. The valve of claim 9 wherein said angle is selected from the approximate range of form 2° to 25°.

11. The valve of claim 10 wherein said angle at least closely approximates 15°.

12. The valve of claim 1 wherein said flow passage means is disposed on said axis, centrally of said pin.

13. The valve of claim 12 wherein said flow passage means, when viewed in cross-section, is a segment of a circle defined by an arcuate wall, underlying on an arc of said circle, that intersects a flat wall, defining a chord of said circle, parallel to said working surface.

14. The valve of claim 13 wherein the cross-sectional area of said flow passage means is selected from the range of from 0.001 to 0.005 $in^2$.

15. The valve of claim 1 further comprising means for releasably locking said pin in a fixed position within said housing.

16. The valve of claim further comprising a fluid distributing means connected to the outlet of said valve for receiving fluid therefrom at said near constant flow rate.

17. The valve of claim 16 wherein said fluid distributing means is a sprayer.

18. The valve of claim 16 wherein said fluid distributing means is drip-type emitter.

19. A pressure-modulated flow control valve means for maintaining a predetermined near constant flow rate of fluid from an outlet thereof despite fluctuations in fluid pressure communicated to an inlet to said valve means, said valve means comprising an unitary pin having a longitudinal axis and adapted and sized for insertion into a bore of a housing, said pin being entirely composed of an elastomeric material and having a solid body portion defining substantial outer surface portions adapted to engage an inner wall defining the bore in said housing, said pin comprising, flow passage means defined through said pin for communicating said inlet with said outlet, a sub-chamber defined entirely within said pin to have only one open end exposed to said inlet, and flexible diaphragm means separating aid sub-chamber from said flow passage means, and having a working surface exposed to said sub-chamber for flexing said diaphragm means into and varying the size of said flow passage means, against a firm and solid backup provided by the substantial outer surface portions of said body portion, to maintain the flow rate of fluid at the outlet of said valve means at said predetermined near constant flow rate in response to a differential in fluid pressure produced between said sub-chamber and said flow passage means.

* * * * *